United States Patent [19]

Ichikawa

[11] Patent Number: 5,018,965

[45] Date of Patent: May 28, 1991

[54] LIQUID FUEL GASIFYING DEVICE AND METHOD FOR PRODUCING THE DEVICE, AND BURNING DEVICE

[75] Inventor: Masaharu Ichikawa, Tokyo, Japan

[73] Assignee: Yaka Feudor K.K., Himeji, Japan

[21] Appl. No.: 436,252

[22] Filed: Nov. 14, 1989

[30] Foreign Application Priority Data

Nov. 18, 1988 [JP] Japan ..... 63-291530
Oct. 19, 1989 [JP] Japan ..... 1-272187

[51] Int. Cl.[5] ..... F23D 14/28
[52] U.S. Cl. ..... 431/344
[58] Field of Search ..... 431/344, 276, 277, 254, 431/255, 150, 142, 131

[56] References Cited

U.S. PATENT DOCUMENTS

| | | | |
|---|---|---|---|
| 2,620,643 | 12/1952 | Nissen | 431/150 |
| 3,884,618 | 5/1975 | Neyret | 431/276 |
| 4,177,646 | 12/1979 | Guadagnin et al. | 431/344 |
| 4,466,788 | 8/1984 | Nitta | 431/344 |

*Primary Examiner*—Carroll B. Dority
*Attorney, Agent, or Firm*—Beveridge, DeGrandi & Weilacher

[57] ABSTRACT

In a liquid fuel gasifying device, a gasifying casing includes a press-fitted portion having an inside diameter equal to the outside diameter of a gas permeable ceramics filter, for receiving the front portion of the gas permeable ceramics filter in a press-fitted state, and a non-press-fitted portion continuing to the gas upstream side of the press-fitted portion and having a slightly larger inside diameter than the outside diameter of the gas permeable ceramics filter, for receiving the rear portion of the gas permeable ceramics filter in a non-press-fitted state. The length of the front portion of the gas permeable ceramics filter sealed with the inner surface of the gasifying casing, and the length of the rear portion of the gas permeable ceramics filter not shielded with the inner surface of the gasifying casing, are set to a length adjusted in accordance with the gas permeability characteristics of the gas permeable ceramics filter.

4 Claims, 3 Drawing Sheets

(a)

(b)

LIQUID FUEL GASIFYING DEVICE AND METHOD FOR PRODUCING THE DEVICE, AND BURNING DEVICE

BACKGROUND OF THE INVENTION

1. Field of the Invention

This invention relates to a liquid fuel gasifying device and a method for producing the device, and a burning device to be used for gas lighters, gas igniters, curling irons, and gas irons.

2. Description of the Prior Art

Gas lighters used for lighting cigarettes with a liquefied gas filled under a high pressure in a gas storage reservoir is designed to gasify the liquefied gas and discharge it as a gaseous fuel out into the atmosphere. The liquefied gas commonly used is a mixture of butane and propane gas.

The gas lighter uses a mixture of both −42.1° C. b.p. propane and −0.5° C. b.p. butane as a fuel gas. This mixture is gasified through high pressure treatment at normal temperature and stored in a state of fluid in the gas storage reservoir of the gas lighter. The fuel, when burned, is changed into a gas under reduced pressure so that it can be discharged out into the atmosphere under an appropriate gas pressure. For this purpose, the gasifying device is used. As an important function of this gasifying device, it is necessary to change the fuel stored in a state of liquid in the gas storage reservoir of the lighter under reduced pressure into a gas by passing through a gasifying casing and, at the same time, to apply, to the liquefied gas, a sufficient amount of heat required for the gasification of the fuel.

Furthermore, the gasifying device requires a function to regulate the quantity of gas to be supplied in the course of, or before and after, gasification.

FIG. 4 is a sectional view of a gasifying device of a gas lighter disclosed Japanese Patent Publication No. 63-26285.

The liquefied gas prefilled under a high pressure in a gas storage reservoir 2 of a gas lighter body 1 produced sturdy and gastight of plastics, or charged from outside under a high pressure via a filling valve (not shown) provided in the gas lighter body 1, is led into a gasifier 4 by a wick 3 made of porous or fibrous material.

The gasification of the liquefied gas is effected by passing the liquefied gas through a filter 5 made of sintered metal or ceramics which is a porous gasifying member with which one end of the wick 3 is in contact to lead the liquefied gas through by utilizing the capillary action of the wick 3.

As an ignition lever not shown or other for igniting the lighter is operated, a nozzle 6 is pushed upward, thus allowing a gas shut off plug 7 installed to the nozzle 6 to move upward.

At the center of the top section of the metal gasifying casing 8 of the gasifier 4 is formed a gas passage 9. With the upward movement of the gas shut-off plug 7 together with the nozzle 6, the liquefied gas passes, with a pressure of its own, through the filter 5 while gasifying and simultaneously decreasing in pressure, passing at the center of the nozzle 6 to be discharged outside at a tip 1 of the nozzle 6.

The gas thus gasified that has reached the tip 10 is ignited with a spark produced by a flint or a piezoelectric element not shown, burning at the tip 10.

Heat necessary for the gasification of the liquefied gas is supplied from the filter 5 and the casing 8 of the gasifier 4 which, being in contact with the liquefied gas, serve as a heat source.

The gasifying device of FIG. 4 is extremely useful, in the respect that no flame length adjusting means is needed, as compared with that using a compressible porous member as a filter. However, when ceramics having good gas permeation temperature characteristics are used for the filter 5 in place of sintered metal which permits the permeation of an increased amount of gas at a temperature of around 30° C. to 40° C., it is necessary to adjust, at the time of manufacture of the filter, the amount of gas to be produced through the ceramics filter, which determines the flame length, because the gas permeation characteristics slightly vary with each production lot of ceramics voluminously produced. It, however, becomes an important problem, in controlling a manufacturing cost, how the amount of gas to be produced through the ceramics filter can be adjusted when very cheap, disposable lighters are manufactured.

Furthermore, there arises such a problem that the gasifying device shown in FIG. 4 is not enough to supply sufficient heat for the stabilized gasification of the liquefied gas through ceramics of the filter 5, resulting in an unstable flame.

SUMMARY OF THE INVENTION

It is, therefore, the first object of the present invention to solve the above-described problems by providing a liquid fuel gasifying device which is economical and capable of easy adjustment of the amount of gas to be produced, at the time of manufacture.

More particularly, in order to accomplish the first object, the gasifying device of the present invention has a gasifying casing which includes a press-fitted portion having an inside diameter equal to the outside diameter of a gas permeable ceramics filter, for receiving the front portion of the gas permeable ceramics filter in a press-fitted state, and a non-press-fitted portion continuing to the gas upstream side of the press-fitted portion and having a slightly larger inside diameter than the outside diameter of the gas permeable ceramics filter, for receiving the rear portion of the gas permeable ceramics filter not press-fitted. The length of the front portion of the gas permeable ceramics filter shielded with the inner surface of the gasifying casing, and the length of the rear portion of the gas permeable ceramics filter not shielded with the inner surface of the gasifying casing, are set to a length adjusted in accordance with the gas permeability characteristics of the gas permeable ceramics filter.

Next, it is the second object of the present invention to provide a liquid fuel burning device which is capable of burning with a stable flame.

More particularly, in order to fulfill the second object, the gasifying casing and the nozzle are thermally conductibly connected by a burner casing having a good thermal conductivity, so that the heat that the nozzle and the burner casing gain from a burning gas, as heat for the gasification of the liquefied gas, can be transmitted to the gasifying casing.

The foregoing objects and other objects, as well as the advantages, features and uses of the present invention, will become more apparent from the following detailed description thereof, when read in connection with the accompanying drawings.

DESCRIPTION OF THE PREFERRED EMBODIMENTS

Figure 1:
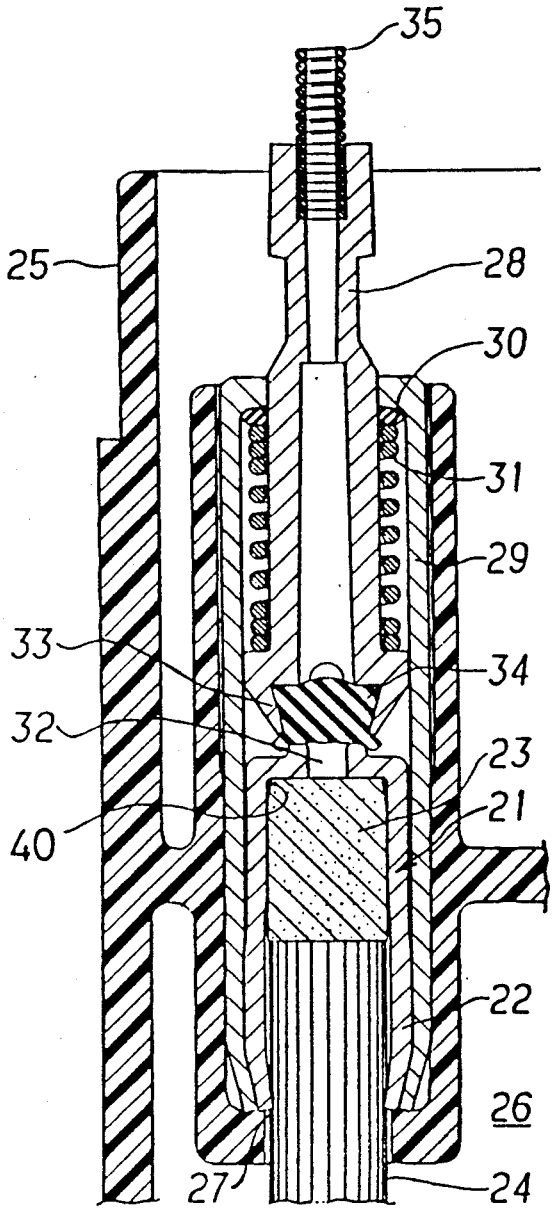
FIG. 1 is a sectional view of a burning device including a gasifying device of a gas lighter according to one embodiment of the present invention.

FIG. 1 is a sectional view showing a burning device including a gasifying device of a gas lighter in accordance with one embodiment of the present invention.

Figure 2:
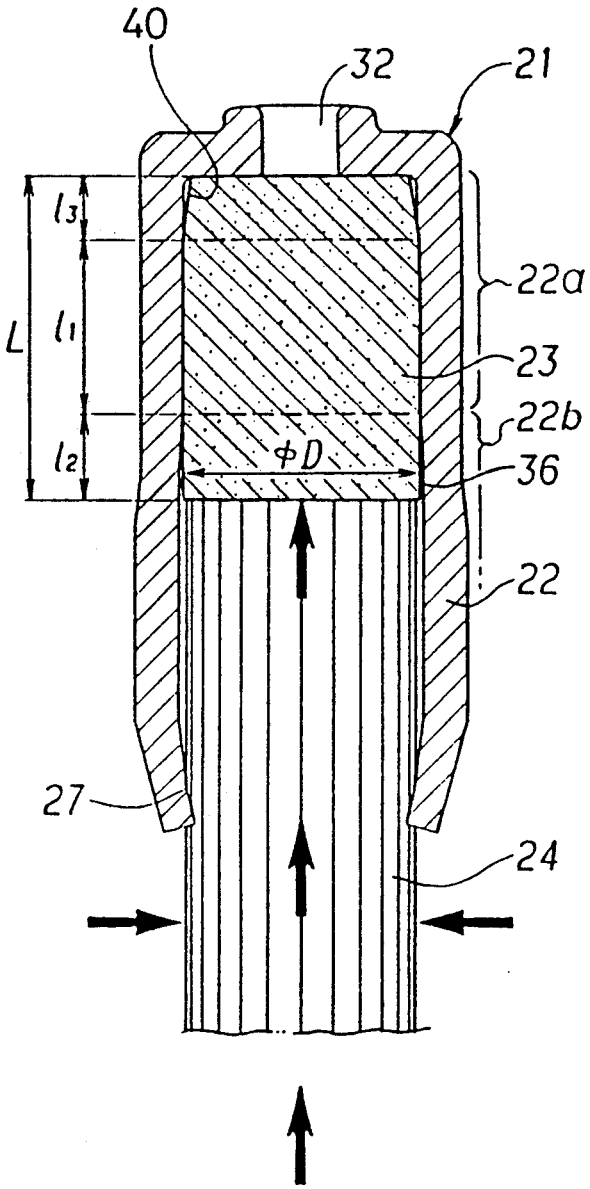
FIG. 2 is a sectional view showing a gasifying device of the gas lighter according to the embodiment of the present invention.

FIG. 2 is a sectional view showing the gasifying device of the gas lighter in accordance with the above-mentioned embodiment of the present invention.

In these drawings, a gasifying device 21 is formed with a cylindrical gas permeable ceramics filter 23 (hereinafter referred to as "the filter") as a gasifying member inserted in a cylindrical gasifying casing 22 produced of a thermally conductive metal or the like.

The filter 23 is produced, for example, of aluminum oxide used as a base material, formed in a cylindrical shape on the whole, and provided with a taper at the top end section 40 at the front that allows easy insertion of the filter 23 into the gasifying casing 22.

The wick 24 made of a porous member or a fibrous member is disposed in the gasifying casing 22 through the opening 27 of the gasifying casing 22 such that when the burning device including the gasifying device 21 is installed in the gas lighter body 25 in order to lead the liquefied gas to the gasifying device 21, its lower end will be long enough to touch the lowermost part of a gas storage reservoir 26 and its top end will come in contact with the filter 23, thus leading the liquefied gas to the filter 23 as indicated by an arrow in FIG. 2.

The metal nozzle 28 is slidably installed in a burner casing 29 with an 0-ring 30 and a burner spring 31 mounted to keep gas-tightness between the nozzle 28 and the burner casing 29 made of thermally conductive metal or other, and the gasifying device 21 is press-fitted in the lower portion of the nozzle 28 in the burner casing 29.

The gasifying device 21, the nozzle 28 and the burner casing 29 are integrally pre-installed as a unit of the burning device, and then mounted to the gas lighter body 25.

At the center of the upper part (the end section on the gas downstream side) of the gasifying casing 22 of the gasifying device 21 is formed a gas passage 32. When the nozzle 28 is slid upward against the elasticity of a burner spring 31 to ignite the lighter, the gas thus gasified passes through the filter 23, being discharged to the nozzle 28 through this gas passage 32.

In the recess 33 provided beneath the nozzle 28 is mounted a gas shut-off plug 34 made of rubber. Usually when the lighter is not used, the nozzle 28 is slid downward with the elasticity of the burner spring 31 to press the lower surface of the gas shut-off plug 34 to the gas passage 32 of the gasifying casing 22, in order to stop the gasification and discharge of the gas.

At the tip of the nozzle 28 is provided a nozzle spring 35 for controlling the gas-air mixture ratio and stabilizing ignition by an electric spark.

In the gasifying casing 22 of the gasifying device 21 of the present invention, as shown in detail in FIG. 2, an opening 27 is formed in its lower part (the end on the gas upstream side) which is open toward the gas storage reservoir 26, and the gas passage 32 in its upper part (the end on the gas downstream side). The gasifying casing 22 has a press-fitted portion **22*a* having a slightly smaller inside diameter than the outside diameter of the filter 23, and a non-press-fitted portion 22*b* whose inside diameter is larger by the amount of a clearance 36 than the outside diameter of the filter 23**.

Therefore, as shown in FIG. 2, when the filter 23 is fitted in such that its upper surface comes in contact with the gas passage 32 of the gasifying casing 22, the front part of the filter 23 is shielded at the press-fitted portion **22*a* of the gasifying casing 22, while the rear part of the filter 23 comes to be unshielded at the non-press-fitted portion 22*b* where its outer periphery faces the inner surface of the non-press-fitted portion 22*b* over the clearance 36**.

The filter 23 has a fixed length L. The front part of the filter 23 corresponding to the press-fitted portion **22*a* of the gasifying casing 22 also has a fixed length $l_1+l_3$, where $l_3$ is the length of the top inclined section 40. The length $l_2$ of the filter 23 corresponding to the non-press-fitted portion 22*b* of the gasifying casing 22 becomes $[L-(l_1+l_3)]$. This length $l_2$ becomes the length adjusted in accordance with the gas permeation characteristics of the filter 23. To describe this more particularly, the amount of gas thus produced, that is, the length of flame at the burner of the lighter is related with (1) the size, shape and volume (porosity) of the bore that can be obtained from the size (material) of particles of the filter 23, (2) the outside diameter ($\phi$D) of the filter 23, (3) the length $l_2$ of the rear part of the filter 23 not shielded with the non-press-fitted portion 22*b* of the gasifying casing 22** at the time of insertion, and (4) a gas pressure.

Therefore, when the above items (1), (2) and (4) remain unchanged, the amount of the gas produced can be adjusted by changing the length $l_2$ of the filter 23.

Since the gas passing through the filter 23 can not go out through the outer periphery of the press-fitted portion **22*a*, a flow passage resistance is proportional to the length of the filter 23. Accordingly, with an increase in the length of the part of the filter 23 (length, $l_1+l_3$) shielded by the press-fitted portion 22*a***, the length $l_2$ of the unshielded portion decreases and the amount of gas produced decreases. Reversely, with a decrease in the length $l_1+l_3$, the length $l_2$ of the unshielded portion increases, thus increasing the amount of the gas produced.

As regards the adjustment of the length $l_2$ of the unshielded portion of the filter 23, a plurality of types of gasifying casings 22 which vary in steps in the length of the press-fitted portion **22*a* are manufactured, and a gasifying casing 22 whose press-fitted portion 22*a* has a suitable length is selected in accordance with the gas permeation characteristics of the filter 23** sampled by each production lot.

Figure 3:
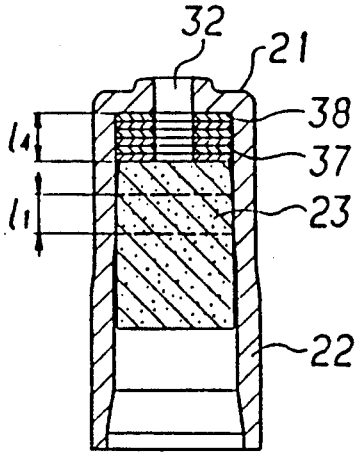
FIGS. 3A and 3B are sectional views showing a gasifying device of a gas lighter according to another embodiment of the present invention.
Figure 3:
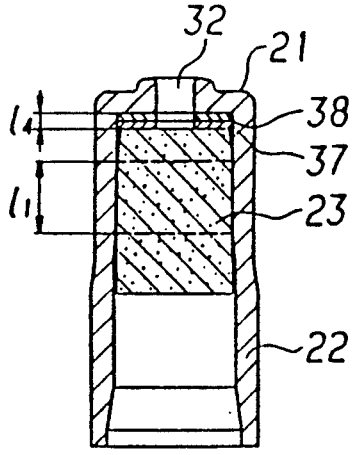
Figure 4:
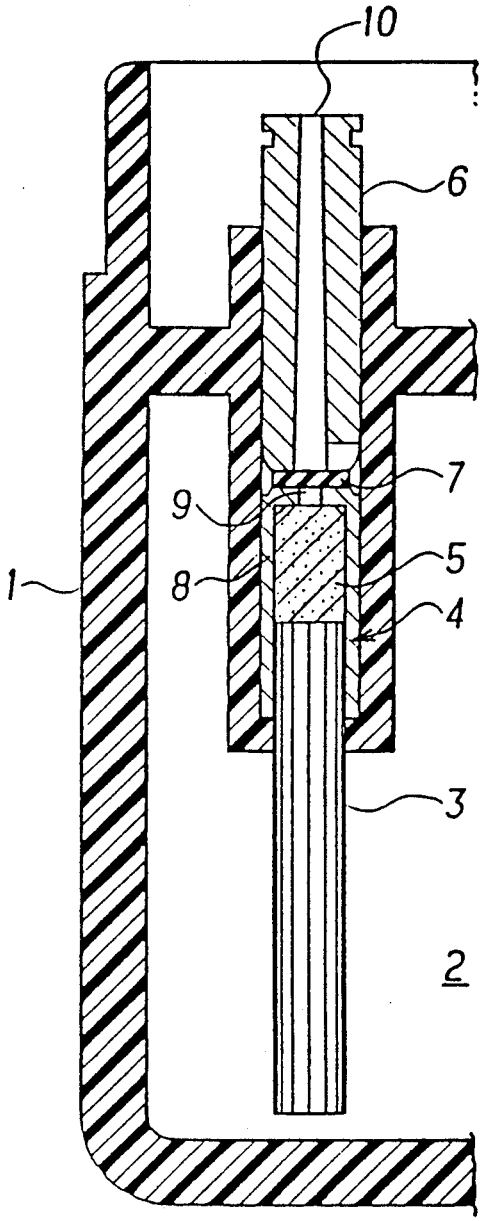
FIG.4 (PRIOR ART)
FIG. 4 is a sectional view showing a burning device including a gasifying device of a conventional gas lighter.

However, in place of the plurality of types of gasifying casings 22 which vary in steps in the length of the press-fitted portion **22*a***, only one type of gasifying casing 22 may be manufactured, and the length $l_2$ of the unshielded portion of the filter 23 may be adjusted by stopping the filter 23 before it contacts the gas passage 32 of the gasifying casing 22. In this case, however, as shown in each of FIG. 3 (*a*) and (*b*), between the gas passage 32 of the gasifying casing 22 and the top end face of the filter 23 there is formed a space 37 of the length $l_4$, in which the gas produced will accumulate and change back into the liquid, giving an adverse effect to igniter performance. To prevent this, as many washer-like discs 38 of specific thickness as the length $l_4$ may be inserted into the space 37.

In either case, each device will require no adjustment and a stabilized amount of gas produced is obtainable without pressing the filter 23 of a fixed length L after the adjustment of the length of the press-fitted portion 22*a* as a sample and the determination of an optimum length unless the above items (1), (2) and the gas pressure are changed.

As for the material of the filter 23, the gas permeable ceramics have a better temperature characteristics of gas than sintered metals, and the length $l_2$ of the unshielded portion of the filter 23 is changed by changing the length of the press-fitted portion 22*a* of the gasifying casing 22, not by changing the length of the filter 23. The gas permeable ceramics are adopted as a gasifying member of the gasifying device used in gas lighters and gas igniters, thereby easily realizing an economical gasifying device which is capable of producing a stabilized amount of gas for lighting a cigarette.

In the filter 23 having the fixed length L, the part of the length $l_1$ of the front part corresponding to the press-fitted portion 22*a* of the gasifying casing 22 may be designed to be set to a length adjusted in accordance with the gas permeation characteristics of the filter 23. That is, attention is paid to the length $l_1$ of the shielded portion, not to the length $l_2$ of the unshielded portion of the gas permeable ceramics filter 23 as previously stated, thereby setting this portion to the length adjusted according to the gas permeability characteristics.

The filter 23 and the gasifying casing 22 are both very small products, which require high techniques for processing materials and products, resulting in a slight variation in length by each production lot in voluminous production. Therefore, if the filter 23 and the gasifying casing 22 thus manufactured are constantly the filter 23 of a fixed length and the gasifying casing 22 having the press-fitted portion 22*a* of a fixed length, the part to be set to the length in accordance with the gas permeation characteristics may be either the unshielded portion (a portion corresponding to the length $l_2$) or the shielded portion (a portion corresponding to the length $l_1$ or the length $l_1+l_3$). However, if there takes place any slight variation in product length, it is necessary to prepare a plurality of filters 23 and/or gasifying casings 22 which vary in steps in the overall length; from among these products, a suitable gasifying casing 22 is selected and assembled in accordance with the gas permeability characteristics of the filter 23 to be selected for use. In either case, when the items (1), (2) and the gas pressure previously stated are kept the same, with the filter 23 fitted in the gasifying casing 22, the flame length at the lighter burner is adjusted by the length of the filter 23, the length of the press-fitted portion 22*a* of the gasifying casing 22, and a relative positional relation of both.

Next, a stabilized burning structure such as the gas lighter and the gas igniter, that is, a structure for supplying stabilized heat for gasifying the liquefied gas, will be explained.

According to the embodiment of the present invention illustrated, all of the gasifying casing 22, the nozzle 28, and the burner casing 29, are produced of a metal material of good thermal conductivity.

When the gas lighter is lit, the liquefied gas in the gasifying device 21 receives heat accumulated in the metal gasifying casing 22 and the filter 23 in contact with the liquefied gas, thus starting gasification and discharge of the liquefied gas. The gas thus discharged is ignited by a spark produced by a flint or a piezoelectric element, burning to form a flame above the nozzle spring 35 at the lighter burner.

The heat of the flame passes, by radiation and conduction, to the filter 23 through the nozzle 28, the burner casing 29, and the gasifying casing 22 of the gasifying device 21, being supplied as an evaporation heat necessary for gasification to the liquefied gas.

As stated above, the gas permeable ceramic material is used as a gasifying member of the gasifying device such as the gas lighter, and the gasifying casing 22, the nozzle 28 and the burner casing 29 are all formed of good thermal conductivity; accordingly, during the initial period of gasification of the liquefied gas, the heat accumulated in the filter 23 and the gasifying casing 22 is supplied as an evaporation heat; and with the start of gas burning, the heat produced by this burning of gas is positively supplied as an evaporation heat for the gasification of the liquefied gas, thereby stably supplying the liquid gas evaporation heat notwithstanding ambient environmental conditions. Therefore, it is possible to always provide a stabilized amount of gas to produce a steady flame of the gas lighter.

As explained above, the use of the liquid fuel gasifying device and its manufacturing method can easily adjust the amount of gas produced, in an economical manner at the time of manufacturing, and provide a flame of a fixed length.

Furthermore, a constantly stabilized flame can be obtained by using a liquid fuel burning device according to the present invention.

What is claimed is:

1. A liquid fuel gasifying device including a cylindrical gas permeable ceramics filter, and a cylindrical thermally conductive gasifying casing which has inside said gas permeable ceramics filter, opening at the end on the gas upstream side toward a gas storage reservoir, and has a gas passage formed at the end on the gas downstream side which is opened and closed by a gas shut-off plug, characterized in that said gasifying casing comprises a press fitted portion having an inside diameter equal to the outside diameter of said gas permeable ceramics filter which receives the front part of said gas permeable ceramics filter in a press-fitted state; and a non-press-fitted portion continuing to the gas upstream side of said press-fitted portion, and having an inside diameter slightly larger than the outside diameter of said gas permeable ceramics filter for receiving, in a non-press-fitted state, the rear part of said gas permeable ceramics filter, with said gas permeable ceramics filter fitted in said gasifying casing, the front peripheral surface of said gas permeable ceramics filter being shielded with the inner surface section of said gasifying casing, and the rear peripheral surface of said gas permeable ceramics filter being not shielded with the inner surface section of said gasifying casing.

2. A method for manufacturing a liquid fuel gasifying device as claimed in claim 1 wherein, for said gas permeable ceramics filter having a fixed overall length, a plurality of gasifying casings which vary in steps in the length of the press-fitted portion which shields the front peripheral surface of said gas permeable ceramics filter are prepared, and from among the plurality of gasifying casings, a gasifying casing the length of whose press-fitted portion fit to the gas permeability characteristics of a gas permeable ceramics filter to be used is selected, and said gas permeable ceramics filter is fitted in said gasifying casing.

3. A method for manufacturing a liquid fuel gasifying device as claimed in claim 1 wherein, for said gasifying casing having a press-fitted portion of fixed length for shielding the front peripheral surface of said gas permeable ceramics filter, a plurality of gas permeable ceramics filters which vary in steps in overall length are prepared, and from among, said plurality of gas permeable ceramics filters is selected a filter of a length in accordance with the gas permeability characteristics desired and fitted in said gasifying casing.

4. A liquid fuel burning device including a gasifying device as claimed in claim 1 in combination with a nozzle and wherein said gasifying casing and said nozzle are thermally conductibly connected by a thermally conductive burner casing.

* * * * *